US006926060B2

(12) United States Patent
Mark

(10) Patent No.: US 6,926,060 B2
(45) Date of Patent: Aug. 9, 2005

(54) COLLAPSIBLE PARTITION STRUCTURE AND BACKSTOP SYSTEM

(76) Inventor: Justin Mark, 1029 Capistrano Ave., Spring Valley, CA (US) 91977

( * ) Notice: Subject to any disclaimer, the term of this patent is extended or adjusted under 35 U.S.C. 154(b) by 85 days.

(21) Appl. No.: 10/682,350

(22) Filed: Oct. 9, 2003

(65) Prior Publication Data

US 2005/0077014 A1 Apr. 14, 2005

(51) Int. Cl.[7] ..... A47G 5/00

(52) U.S. Cl. ..... 160/135; 473/476; 135/98; 135/133

(58) Field of Search ..... 160/135, 351, 160/352; 52/239; 273/350, 398; 473/471, 472, 479, 481, 485, 476; 135/135, 98, 124, 125, 133, 138

(56) References Cited

U.S. PATENT DOCUMENTS

| | | | | |
|---|---|---|---|---|
| 1,043,308 A | | 11/1912 | Everson | |
| 1,170,715 A | | 2/1916 | Westgate | |
| 1,540,670 A | | 6/1925 | Vidmer | |
| 1,652,062 A | | 12/1927 | Stauffer | |
| 2,008,359 A | | 7/1935 | Lamb | |
| 2,059,365 A | | 11/1936 | King | |
| 2,587,698 A | * | 3/1952 | Corn, Jr. et al. | 160/135 |
| 2,922,653 A | | 1/1960 | O'Brien | |
| 2,988,360 A | | 6/1961 | Lambiotte | |
| 3,001,795 A | | 9/1961 | Johnson | |
| 3,463,218 A | * | 8/1969 | Byrens et al. | 160/135 |
| 3,565,152 A | * | 2/1971 | Cohn et al. | 160/135 |
| 3,656,750 A | | 4/1972 | Neunier | |
| 3,822,063 A | | 7/1974 | Rea | |
| 3,858,880 A | | 1/1975 | Graves | |
| 3,945,641 A | | 3/1976 | Carbonero | |
| 3,948,512 A | | 4/1976 | Worthington | |
| 3,980,304 A | | 9/1976 | O'Neill et al. | |

(Continued)

OTHER PUBLICATIONS

A 2 Z Sports, Jugs Instant Screen, On–Line Sporting Goods Catalog, http:///www.a2zsports.com; Jun. 27, 2000, 1 page, United States.

Baseball Batting Cages, The Zone Pitchers' Training System, http://www.basballbattingcages.com, Aug. 24, 2001, 1 page United States.

Baseball Batting Cages, Portable Backstops, http://www-.baseballbattingcages.com, Aug. 24, 2001, 1 page, United States.

Baseball Batting Cages, Fielder Screen, http://www.baseballbattingcages.com, Aug. 24, 2001, 1 page, United States.

The Jugs Company, Jugs Instant Backstop™, http://thejugscompany.com, Jun. 27, 2000; 1 page, United States.

The Jugs Company, Jugs Instant Backstop™, http://thejugscompany.com, Sep. 11, 2001; 1 page, United States.

(Continued)

*Primary Examiner*—David Purol
(74) *Attorney, Agent, or Firm*—Senniger Powers

(57) ABSTRACT

A partition structure defining compartments shielded from moving objects, such as baseballs, from other compartments. The structure comprises a central support and at least three partition walls extending substantially radially outwardly from the central support to define at least three compartments. Each partition wall includes a lower frame element and a pliable web of material extending therefrom for shielding one of the compartments from the others. The partition structure is preferably collapsible and may be anchored to the ground via stakes. A collapsible backstop system is also disclosed, comprising a collapsible backstop and a container for receiving the collapsible backstop in its collapsed configuration for storing or transporting the backstop.

28 Claims, 15 Drawing Sheets

U.S. PATENT DOCUMENTS

| | | | | | |
|---|---|---|---|---|---|
| 3,986,719 | A | | 10/1976 | Lee | |
| 4,045,032 | A | | 8/1977 | Cox | |
| 4,088,317 | A | | 5/1978 | Gierla | |
| 4,275,883 | A | | 6/1981 | Grimaldi et al. | |
| 4,336,942 | A | | 6/1982 | Warehime | |
| 4,491,141 | A | | 1/1985 | Eppenbach | |
| 4,590,956 | A | | 5/1986 | Griesenbeck | |
| 4,688,804 | A | | 8/1987 | Maxwell | |
| 4,702,478 | A | | 10/1987 | Kruse | |
| 4,815,736 | A | | 3/1989 | Wright | |
| 4,822,053 | A | | 4/1989 | Flaherty | |
| 4,883,272 | A | | 11/1989 | Lay | |
| 4,886,268 | A | | 12/1989 | Langslet | |
| 4,895,366 | A | | 1/1990 | Bartasius | |
| 4,913,427 | A | | 4/1990 | Wilson | |
| 4,948,141 | A | | 8/1990 | Newman | |
| 5,088,740 | A | | 2/1992 | Peterson | |
| 5,193,802 | A | | 3/1993 | Saltus | |
| 5,205,564 | A | | 4/1993 | Lamberti et al. | |
| 5,222,731 | A | | 6/1993 | Hanabusa et al. | |
| 5,240,246 | A | | 8/1993 | Gohil et al. | |
| 5,244,213 | A | | 9/1993 | Armell | |
| 5,269,527 | A | | 12/1993 | Noval | |
| 5,310,176 | A | | 5/1994 | Berg | |
| 5,326,109 | A | | 7/1994 | Robl | |
| 5,351,948 | A | | 10/1994 | Thomas | |
| 5,368,293 | A | | 11/1994 | Waugh | |
| 5,402,999 | A | * | 4/1995 | Keehn, Sr. | 473/472 |
| D359,538 | S | | 6/1995 | Hague | |
| 5,427,381 | A | | 6/1995 | Macaluso et al. | |
| 5,433,433 | A | | 7/1995 | Armell | |
| 5,505,443 | A | | 4/1996 | Padilla | |
| 5,520,397 | A | | 5/1996 | Thompson | |
| 5,524,901 | A | | 6/1996 | Bison et al. | |
| 5,540,428 | A | | 7/1996 | Joseph | |
| 5,569,094 | A | | 10/1996 | Macaluso | |
| 5,577,721 | A | | 11/1996 | Hardee et al. | |
| 5,580,048 | A | | 12/1996 | Mullen et al. | |
| 5,584,480 | A | | 12/1996 | Grimsrud | |
| 5,586,594 | A | * | 12/1996 | Shapoff | 160/135 |
| 5,681,230 | A | | 10/1997 | Krings | |
| 5,689,926 | A | * | 11/1997 | Nichols | 52/282.2 |
| 5,722,905 | A | * | 3/1998 | Bidelman | 473/451 |
| 5,730,442 | A | | 3/1998 | Anderson | |
| 5,733,209 | A | | 3/1998 | McIntyre, IV | |
| 5,906,553 | A | | 5/1999 | Carroccio | |
| 6,068,041 | A | * | 5/2000 | Miles et al. | 160/135 |
| 6,083,124 | A | | 7/2000 | Williams | |
| 6,168,540 | B1 | | 1/2001 | McKenna | |

OTHER PUBLICATIONS

The Jugs Company, Instant Screen®, http://thejugscompany.com, Sep. 11, 2001; 1 page, United States.

The Jugs Company, Use and Instructions of the Instant Screen at least as early as Sep. 11, 2001; 1 page, United States.

The Jugs Company, Multi–Sport Instant Cage, http://thejugscompany.com, Sep. 11, 2001, 1 page, United States.

The Jugs Company, Introducing the New Jugs QUICK–SNAP Protective Screens, http://thejugscompany.com, Sep. 11, 2001, 3 pages, United States.

The Jugs Company, Soccer Instant Goooal®, http://thejugscompany.com, Sep. 11, 2001, 1 page, United States.

JKP Sports, Focus on the Ball, product catalog, 2002, __ pages, Tualatin, Oregon, United States.

* cited by examiner

COLLAPSIBLE PARTITION STRUCTURE AND BACKSTOP SYSTEM

BACKGROUND OF THE INVENTION

This invention generally relates to partition structures and more particularly to a collapsible and portable partition structure defining compartments capable of shielding occupants from moving objects, such as baseball players from baseballs.

The invention is especially concerned with a partition structure defining compartments for protecting occupants in the compartments from baseballs. The structure must be able to accommodate several batters at once and may be both portable and collapsible. Conventionally, batting cages completely surround a batter so that batting practice may take place within the cage, without hit baseballs exiting the cage and harming property or persons in the nearby area. Batting cages are typically large, allowing for the full 60 foot 6 inch distance from the pitcher, or pitching machine, to the batter to be completely enclosed within the batting cage. As such, batting cages are not typically portable, and if they are portable, often require more than one or two persons for transport to and from a baseball practice area, such as a field.

Also conventionally, backstops protect areas behind and to the sides of the batter's box. Such backstops are useful for conducting baseball games, as they arrest movement of foul balls, wild pitches or errant throws to home plate. For practice, however, such backstops are limited because they provide a protected area for only one set of players to practice pitching, batting, fielding and/or catching. Portable backstops are also known in the art, but similarly suffer from the drawback of being usable with only one batter at a time. A portable structure providing multiple batters and pitchers with a safe area to practice simultaneously, without concern for balls hit or thrown by other players, would provide a substantial benefit over configurations known in the art.

SUMMARY OF THE INVENTION

Among the several objects and features of the present invention may be noted the provision of a partition structure that is collapsible to a collapsed configuration for transport or storage; the provision of a partition structure allowing multiple groups to practice simultaneously without interfering with one another; the provision of a partition structure that is readily erected, collapsed and transported by a single user; the provision of a partition structure that is simple to erect and collapse; the provision of a partition structure that may be utilized for a variety of sporting activities; and the provision of a partition structure that is relatively simple and inexpensive to manufacture.

In one embodiment, a partition structure defines compartments shielded from moving objects, such as baseballs, from other compartments. The structure comprises a central support and at least three partition walls shaped and sized to extend substantially radially outwardly from the central support. The partition walls are constructed to define at least three of the compartments. Each partition wall includes a lower frame element and a pliable web of material extending therefrom for shielding one of the compartments from the others. The web extends from the central support to a radially outer end of the partition wall.

Generally, a collapsible structure for arresting the movement of moving objects comprises a central support oriented substantially vertically. The central support is movable between an erect configuration and a collapsed configuration, wherein the central support is longer in the erect configuration than in the collapsed configuration. At least three lower frame elements are pivotably attachable to a lower end of the central support. The lower frame elements are movable from an erect configuration to a collapsed configuration. Each of the lower frame elements is longer in an erect configuration than in a collapsed configuration. The lower frame elements are substantially perpendicular to the central support and extend laterally outwardly when in the erect configuration and are substantially adjacent the central support when in the collapsed configuration. The collapsible structure further comprises upper frame elements corresponding in number to the at least three lower frame elements. Each of the upper frame elements extends from the central support to a remote end of a corresponding lower frame element. The collapsible structure further comprises webs corresponding in number to the at least three lower frame elements. Each of the webs extends between the central support and a corresponding lower frame element and is movable from a substantially erect configuration, wherein each web is oriented substantially vertically to arrest movement of the moving objects, to a substantially collapsed configuration, wherein each web is substantially parallel and substantially adjacent a corresponding lower frame element and the central support.

In another aspect, a collapsible backstop system comprises a collapsible backstop shaped and sized to arrest movement of objects. The collapsible backstop is capable of alternating between an erect configuration for arresting the movement of objects, and a collapsed configuration shaped and sized for transport or storage. The backstop comprises at least three collapsible partition walls and a central support for mounting each of the partition walls generally as set forth above to divide a volume defined by the backstop into compartments. The partition walls are constructed to shield the compartments from moving objects, such as baseballs, from other compartments. The system further comprises a container shaped and sized for receiving the collapsible backstop in its collapsed configuration for storing or transporting the backstop.

In yet another aspect, a collapsible partition structure defines compartments shielded from moving objects, such as baseballs, from other compartments. The structure comprises at least three partition walls oriented substantially vertically. Each partition wall has a substantially vertical inner end and an outer end opposite the inner end. The inner ends of the partition walls are positioned substantially adjacent one another such that the partition walls extend substantially radially outwardly from the center of the structure. The partition walls are constructed to define at least three of the compartments. Each partition wall includes a pliable web of material extending therefrom for shielding one of the compartments from the others. Each web extends from the inner end of a corresponding partition wall to a radially outer end of the partition wall.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENTS

Figure 1:
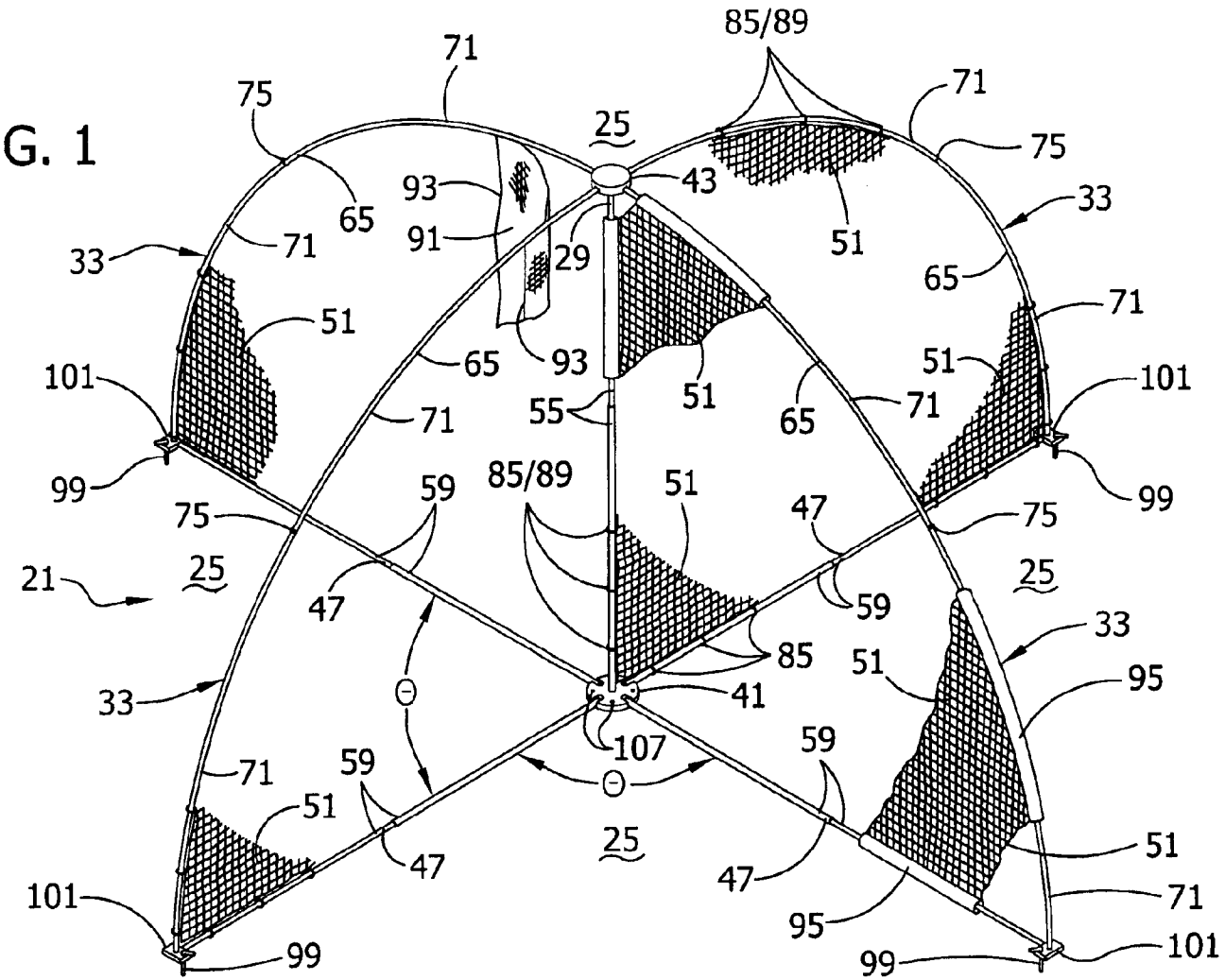
FIG. 1 is a perspective of a collapsible partition structure of the present invention shown in an erect configuration.
Figure 3:
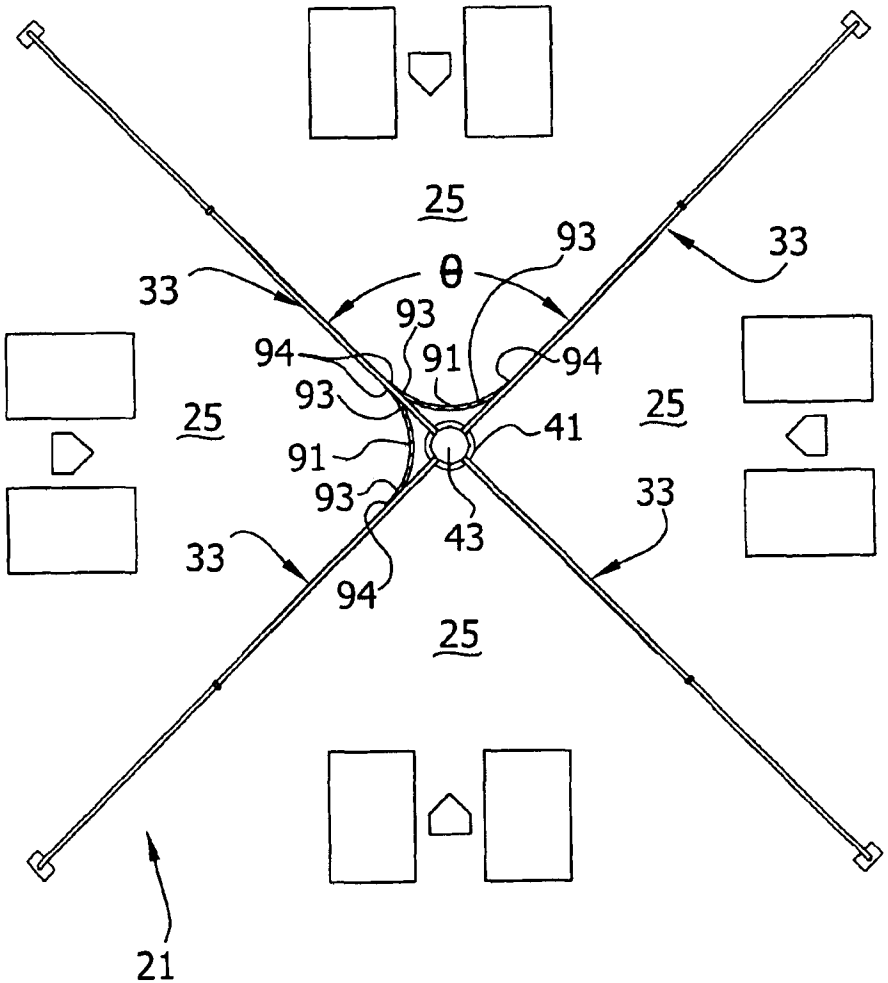
FIG. 3 is a plan view of the partition structure of FIG. 1 further illustrating a plate and batter's box in each compartment defined by the partition structure.

Referring first to FIG. 1, a partition structure of the present invention is generally indicated by reference number 21. Such a structure defines multiple compartments 25 shielded from moving objects, such as baseballs (FIGS. 1 and 3). Each compartment 25 is generally shielded from moving objects (e.g., hit or thrown baseballs) originating from other compartments. The compartments are also shielded, in part, from moving objects originating from outside the compartments. Such shielding is configured to protect occupants of such compartments 25 from being struck by such moving objects. The typical occupants of such compartments 25 are baseball players, although other occupants may include coaches, umpires, spectators, bystanders or any other person or article placed within the compartments. Such a structure is also usable with other sport activities, for example as a golf practice stop, or as a soccer, field hockey or lacrosse goal, among others. Beyond protecting occupants from moving objects, the structure 21 also protects non-occupants from moving objects, because the structure can arrest objects moving on a wayward trajectory away from a particular compartment 25 (e.g., a foul ball).

The structure 21 generally comprises a central support 29 and at least three partition walls, generally indicated 33, shaped and sized to extend substantially radially outwardly from the central support (FIG. 1). These partition walls 33 define a corresponding number (i.e., at least three) of the aforementioned compartments 25 shaped and sized for receiving an occupant. An occupant may be an adult, adolescent or child, such that the size of the structure 21 may vary, depending upon its intended application. In addition, compartments 25 shaped and sized for receiving an occupant include compartments sized and shaped for only partially receiving an occupant, rather than completely receiving an occupant. For example, a structure 21 shaped and sized for receiving children for use as a batting cage may also be useful for partially receiving adults for use as a soccer goal. Again, the use of the structure 21 will influence the relative size of the structure, which may be any number of sizes without departing from the scope of the present invention.

In one embodiment, there are four partition walls 33 and four compartments 25 (FIGS. 1 and 3), although a fewer or greater number of walls and compartments (e.g., 3, 5, 6, etc.) is also contemplated as within the scope of the invention. Moreover, although each of the partition walls 33: depicted in the figures extends at an identical angle Θ from adjacent partition walls (FIGS. 1 and 3), it is contemplated that the partition walls may extend at different relative angles to one another, thereby providing differently sized compartments 25 in a single structure 21. For example, a structure could include four compartments (not shown), in which the compartments are sized with angles of 70°, 80°, 100° and 110°. The structure 21 may also be designed with sufficient movement, or play, where the partition walls 33 and the central support 29 meet, thereby allowing the position of the walls to be adjusted angularly with respect to one another, so that a single structure may be arranged with variously sized compartments, depending upon the requirements of the user. Such movement or play may be introduced due to the flexibility of the partition walls 33 or because the connections between the partition walls and the central support include tolerances that allow such movement.

Because the partition structure 21 creates multiple compartments 25 that face outward from one another, multiple occupants can participate in multiple practice sessions, simultaneously. Moreover, having all of the occupants in close proximity to one another and the structure 21 allows for simultaneous supervision of the occupants. With multiple compartments 25, one or more of the compartments may be designated for equipment storage, for coaching personnel, for spectators or for any other use requiring close proximity to the occupants, but with protection from moving objects, such as baseballs.

Figure 2:
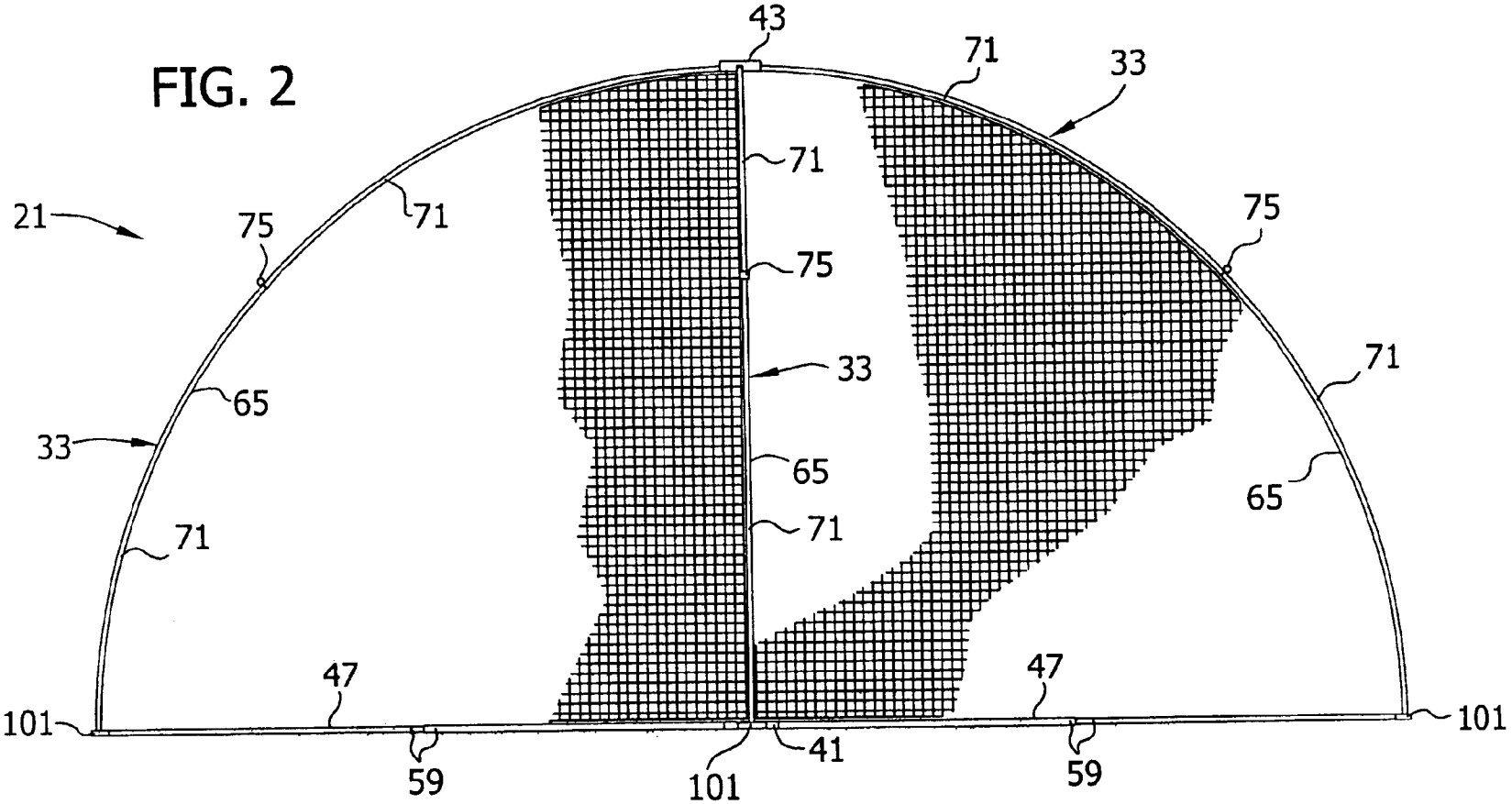
FIG. 2 is an elevation of the partition structure of FIG. 1.

The central support 29 is typically oriented substantially vertically when the structure is configured in an erect configuration, as depicted in FIGS. 1–3. The central support 29 may be oriented other than precisely vertically without departing from the scope of the present invention. For example, the central support 29 may be angled slightly from vertical, without departing from the scope of the present invention. Preferably, the partition walls 33 extend substantially radially from the central support 29, however, such partition walls need not extend precisely radially from the central support. For example, any of the partition walls 33 may bend laterally slightly as they extend from the central support 29. In other words, it is not necessary that each of the partition walls lies in a perfectly flat, vertical plane. Such configurations are contemplated as within the scope of the term "substantially radially."

The central support 29 additionally comprises a base 41 at its lower end and an upper joint 43 at its upper end. Each partition wall 33 includes a lower frame element 47, or lateral support, and a pliable web 51 of material (FIG. 1) extending therefrom between the central support 29 and the lower frame element for shielding each one of the compartments 25 from the others. Each web 51 preferably extends from the central support 29 to a radially outer end of its respective partition wall. As will be described in greater detail below, the lower frame elements 47 are preferably hingedly attached to the base 41 of the central support 29 for pivoting about the base, from a substantially horizontal orientation (FIG. 1) to a substantially vertical orientation (FIGS. 4, 4A and 5) adjacent the central support.

Figure 4:
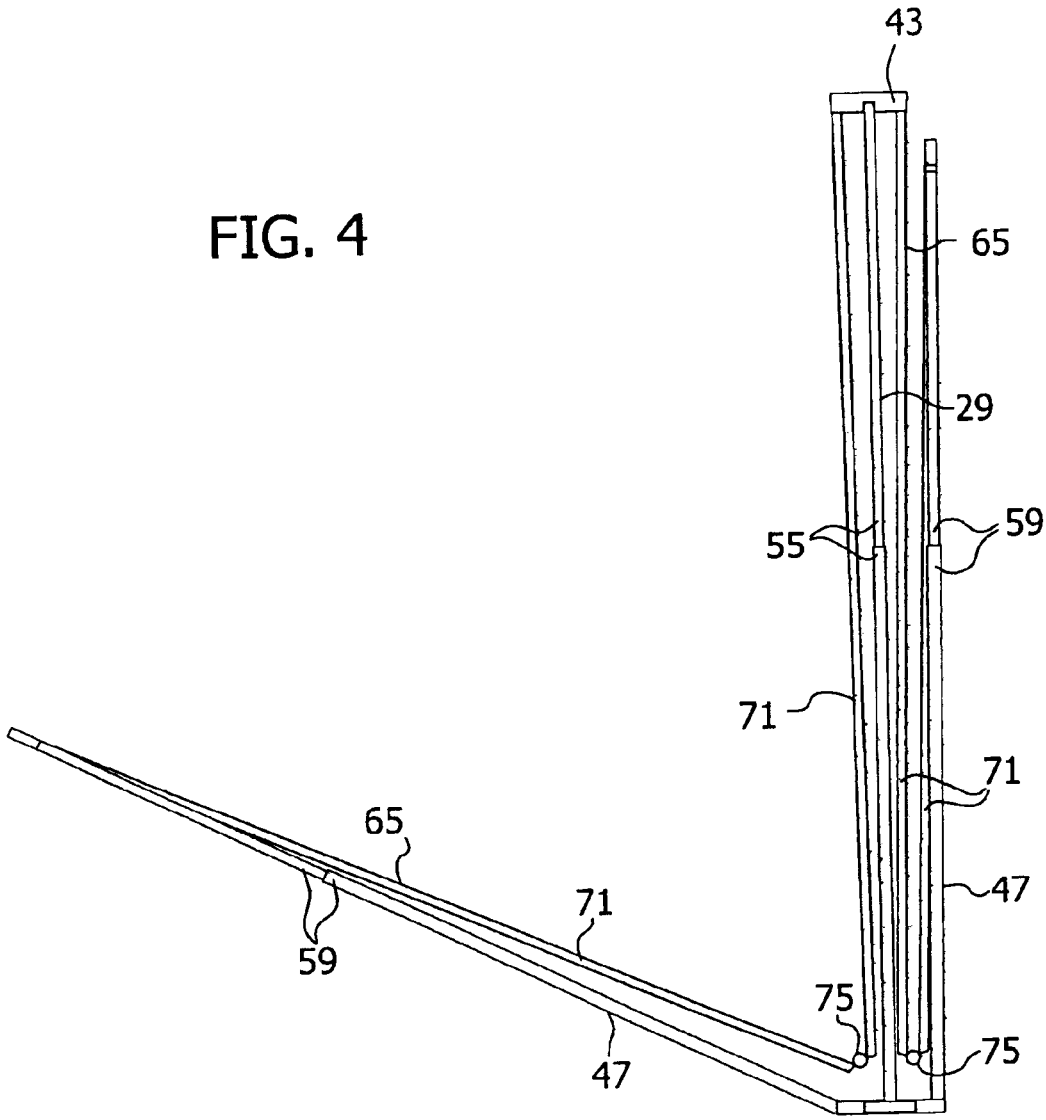
FIGS. 4 and 4A are elevations of the partition structures shown in partially collapsed configurations.
Figure 4A:
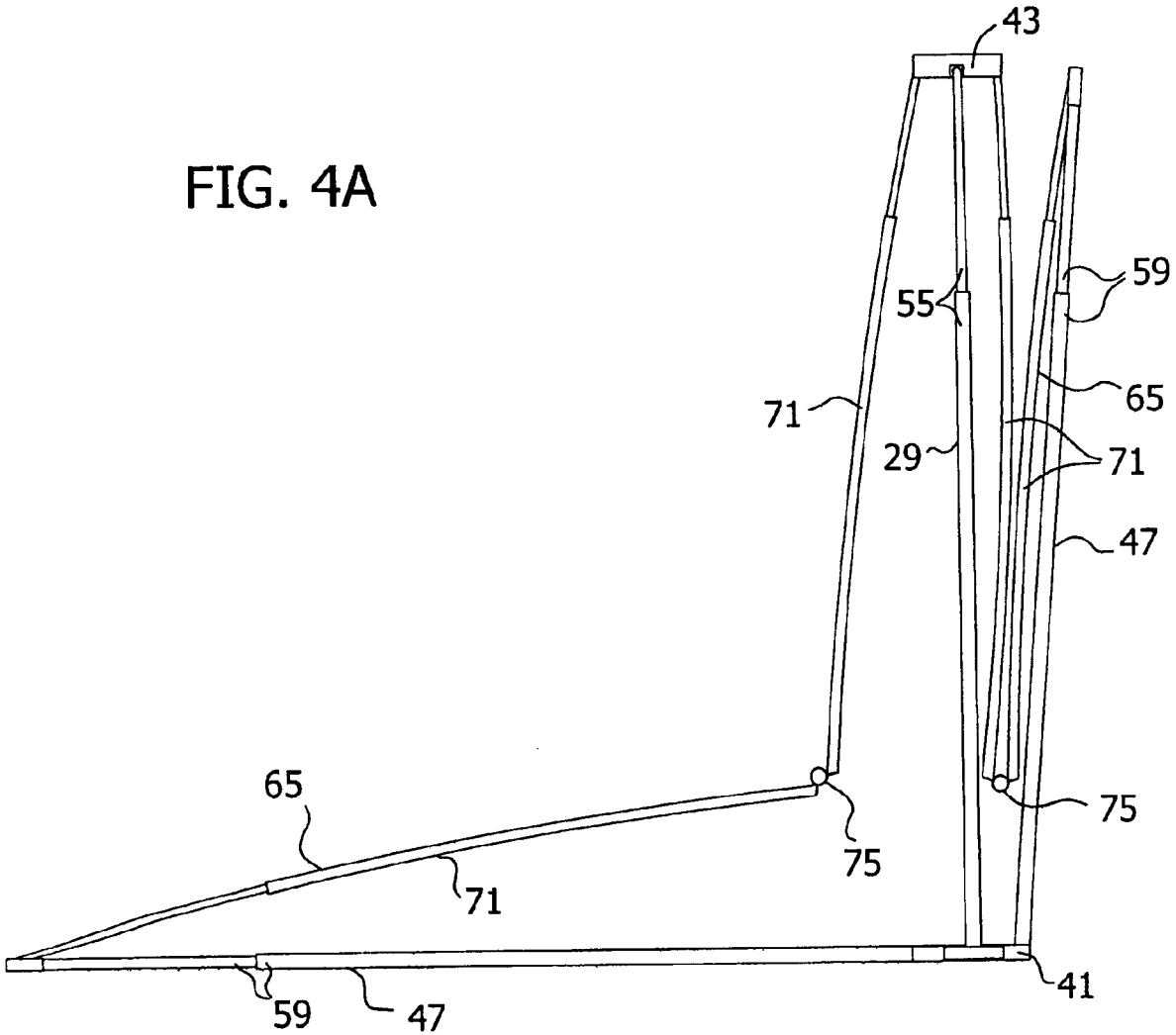
Figure 5:
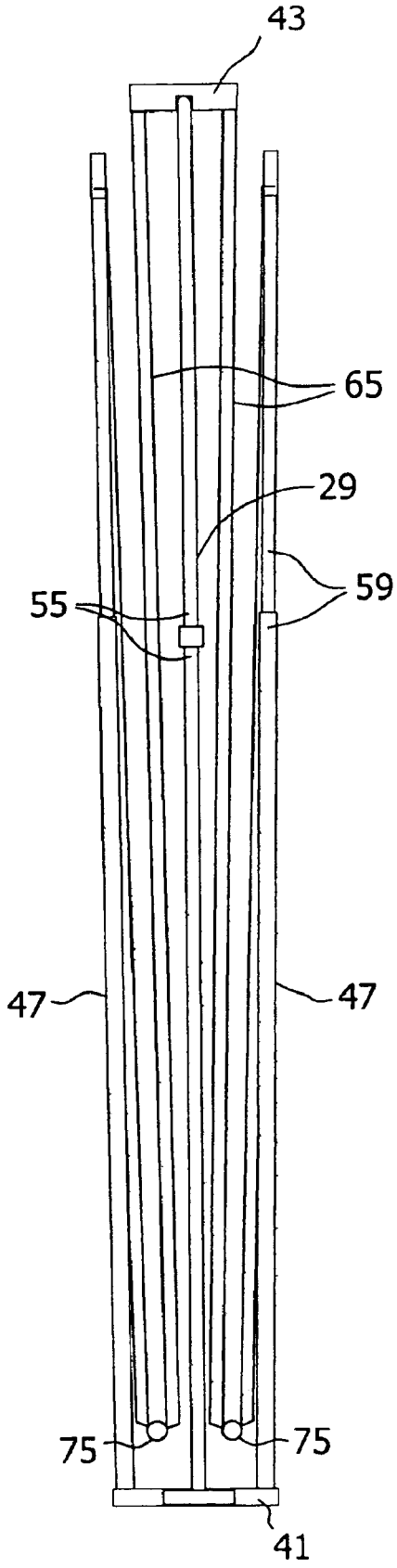
FIG. 5 is an elevation of the partition structure shown in a fully collapsed configuration.

Aside from the structural features described above, the partition structure 21 is additionally collapsible from the erect configuration (FIGS. 1–3) to a collapsed configuration (FIGS. 4, 4A and 5). Once collapsed, the structure 21 may be more easily transported, preferably being capable of being carried by a single person. Such portability makes the structure 21 ideal for transporting to and from a practice location. Although the structure is ideally collapsible, it should be understood that any of the structures 21 disclosed herein may be formed without the ability to collapse without departing from the scope of the present invention.

Concerning collapsibility, the central support 29 and each of the lower frame elements 47 are movable, specifically collapsible, from the erect configuration to the collapsed configuration. In particular, the lower frame elements 47 are positioned substantially adjacent the central support 29 when in the collapsed configuration (FIG. 5). When in the erect configuration, the lower frame elements 47 are substantially perpendicular to the central support 29 and extend laterally outwardly from the central support (FIG. 1). The term "substantially perpendicular" encompasses lower frame elements 47 oriented precisely perpendicular to the central support 29 as well as those lower frame elements oriented substantially perpendicular to the central support.

The central support 29 and the lower frame elements 47 each collapse from a longer, original length in their respective erect configurations to a shorter, collapsed length less than their respective original lengths in their respective collapsed configurations. To accomplish this, the central support 29 and the lower frame elements 47 each comprise two sections, namely central support sections 55 and lower frame element sections 59, respectively. The sections 55,59 are movable with respect to one another to facilitate collapse of the central support and collapse of the lower frame elements from respective erect configurations to respective collapsed configurations. Such sections 55,59 are collapsible in a variety of ways (e.g., telescopingly, hingedly, mating male and female end portions), some of which are described in detail hereinafter. For example, at least one of the at least two central support sections 55 may be telescopingly received by a corresponding other of the central support sections (FIG. 1). This telescoping interaction of the central support sections 55 facilitates collapse of the central support 29 from an erect configuration to a collapsed configuration.

More than two central support sections 55 or lower frame element sections 59 may be employed to allow a greater degree of collapse than with only two sections. For example, two telescoping central support sections 55 allow for collapse of the central support 29 to a collapsed length just greater than half of its original length. With three telescoping central support sections 55, the central support 29 can collapse to a length just greater than one-third of its original length. With a greater number of central support sections 55, the central support 29 is capable of collapsing to a greater degree.

Similarly, the lower frame element sections 59 of FIG. 1 are telescopingly received by a corresponding other of the lower frame element sections to facilitate collapse of the lower frame elements 47 from respective erect configurations to respective collapsed configurations. In both cases, the telescoping sections 55,59 are maintained in their erect configurations with an interference fit between adjacent sections, as would be readily understood by one skilled in the art. The telescoping sections may also be maintained in their erect configurations with a detent arranged on one of the sections and a cooperating recess on the other section, the detent being adapted to engage the recess for holding the sections in place.

In one variation of the partition structure 21', each of the central support sections 55' and/or each of the lower frame element sections 59' are hingedly connected to one another for collapse via hinges 61 (FIG. 6), rather than telescopingly collapsible as with the previous embodiment. Such sections 55',59' may be pivoted with respect to one another about the hinges 61 from an erect configuration, wherein corresponding sections 55',59' are arranged end-to-end, to a collapsed configuration, wherein the sections are substantially parallel and substantially adjacent one another. To maintain their position in the erect configuration, the hinged sections 55',59' may incorporate an over-center configuration or other securement mechanism, as would be understood by one skilled in the art.

Figure 6:
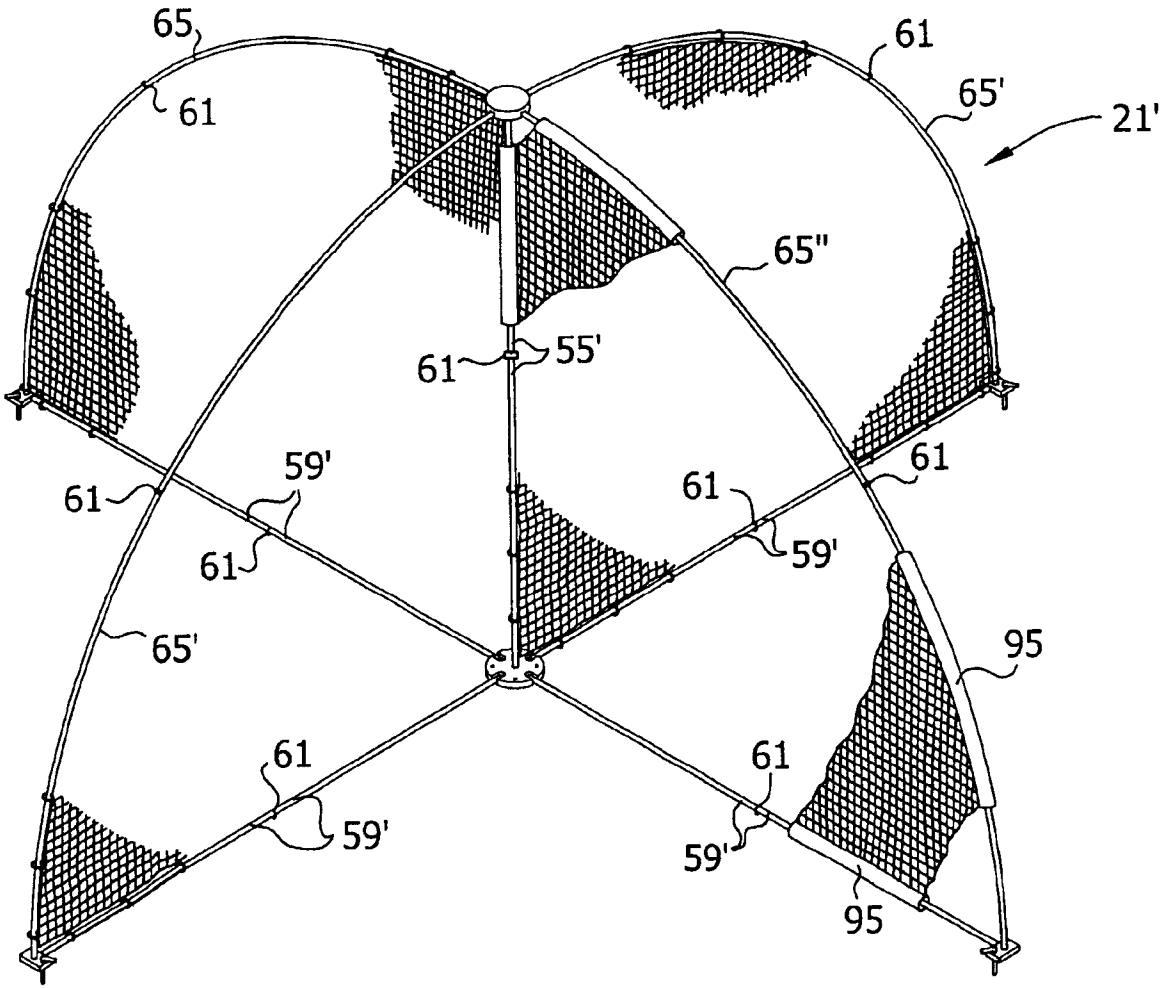
FIG. 6 is a perspective of another collapsible partition structure comprising hinged structural members.
Figure 7:
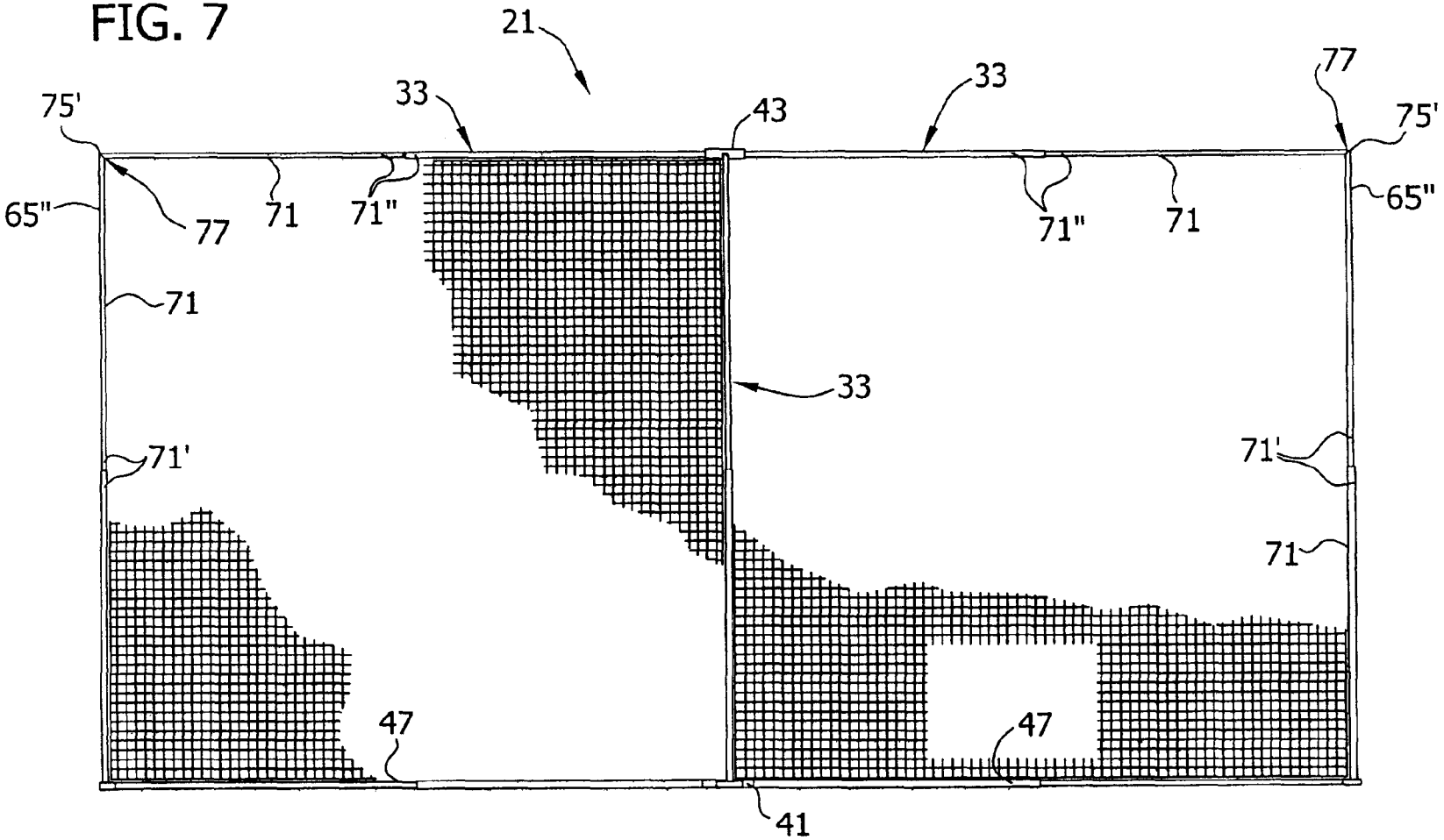
FIG. 7 is an elevation of another collapsible partition structure including upper frame elements having pre-formed bends.

Each of the aforementioned structures 21 further comprises upper frame elements 65 for each of the lower frame elements 47 (FIGS. 1, 2 and 6). However, it is envisioned that some or all of the upper frame elements could be omitted without departing from the scope of the present invention. The central support 29, lower frame elements 47 and upper frame elements 65 may each be referred to generally as structural members. In any event, each of the upper frame elements 65 corresponds to one of the partition walls 33 and extends from the upper joint 43 of the central support 29 to a remote end of a corresponding lower frame element 47. The upper frame elements 65 may be shaped in any number of ways, including straight (not shown), bendable to an arcuate configuration (FIGS. 1 and 2), or including a pre-formed bend (FIG. 7). In the structure 21 depicted in FIGS. 1 and 2, the upper frame elements 65 are generally elongate, flexible portions of material. Suitable materials include fiberglass, aluminum, steel or carbon fiber, among others. Such materials are also suitable for the central support 29 and lower frame elements 47. Because each upper frame element 65 is flexible, when the ends of each upper frame element are maintained at some position nearer one another than the relaxed length of the upper frame element, the element bends into an arcuate shape, as shown. More specifically, the upper joint 43 and the remote end of a respective one of the lower frame elements 47 control the location of the ends of each upper frame element 65, thereby positioning and shaping the upper frame element. Varying the length of the upper frame element 65, the central support 29 or the corresponding lower frame element 47 can alter the curvature of the upper frame element, from substantially straight (not shown) to curved, as depicted in FIGS. 1 and 2. Modifications to the curvature of such upper frame elements 65 are contemplated as within the scope of the present invention.

To facilitate a more compact collapse, the upper frame elements 65 include two upper frame element sections 71 movable with respect to one another for collapsing to a collapsed configuration adjacent the central support 29. A hinge 75 allows the upper frame element sections 71 to pivot with respect to one another (FIG. 4) for collapsing the upper frame elements 65 inward. The hinge 75 may be an over-center configuration to facilitate maintaining the upper frame element 65 in its erect configuration (FIG. 1), without an additional retention mechanism. Other retention mechanisms for maintaining each upper frame element 65 in its erect configuration may be utilized without departing from the scope of the present invention. For example, the hinge 75 may include securable angular stops for positioning upper frame element sections 71 at a particular angle with respect to one another. It will be understood that the upper frame elements 65 may include no sections, or more than two sections, without departing from the scope of the present invention.

Collapsing the structure 21 from its erect configuration (FIG. 1) to its collapsed configuration (FIG. 5) involves the following steps. First, each of the upper frame elements 65 collapses inward toward the base 41 about its hinge 75, as depicted in FIGS. 4 and 4A. This movement may require disengaging an over-center configuration or other securement mechanism, as described above. Once collapsed, the upper frame element sections 71 are oriented substantially parallel to either the central support 29 or a lower frame element 47 (FIG. 4A). Second, movable central support sections 55 (FIGS. 4 and 4A), lower frame element sections 59 (FIGS. 4 and 4A) and upper frame element sections 71 (FIG. 4A), which are telescopingly received by one another, are each slidingly disengaged from one another by releasing their respective interference fits, as would be understood by one skilled in the art. Once disengaged from a corresponding interference fit, the mating sections 55,59,71 may slide with respect to one another, thereby allowing one section to slide within a mating section to decrease the overall length of each structural member 29,47,65, respectively. Third, the collapsed lower frame elements 47 are pivoted about the base 41 of the central support 29, from a substantially horizontal orientation to a substantially vertical orientation, adjacent the central support. This pivoting brings the lower frame elements 47 and upper frame element sections 71 to a substantially vertical orientation adjacent the central support, as depicted in FIG. 5.

The structure of FIG. 7 depicts upper frame elements 65" including 90° pre-formed bends, generally indicated 77. Each of the upper frame elements 65" further comprise two upper frame element sections 71 movable with respect to one another for collapsing to a collapsed configuration adjacent the central support 29. To facilitate collapse, at least one of the upper frame elements 65" includes a hinge 75', thereby allowing the upper frame element sections 71 to pivot with respect to one another. Preferably, the hinge 75' is located at or near the pre-formed bend 77. The upper frame elements 65" are preferably maintained in their erect configuration with an over-center hinge configuration as disclosed above. Other retention mechanisms for maintaining each upper frame element 65" in its erect configuration may be utilized without departing from the scope of the present invention. Other hinge locations are also contemplated as within the scope of the present invention. It will be understood that the upper frame elements 65" may include no sections or more than two sections without departing from the scope of the present invention. It will also be understood that the upper frame elements 65" may include no hinge or more than one hinge without departing from the scope of the present invention.

The upper frame elements 65" each additionally include four upper frame element sections 71, including a substantially vertical pair of upper frame element sections 71' and a substantially horizontal pair of upper frame element sections 71", as depicted in FIG. 7. As with the central support sections 55 and lower frame element sections 59 described above, the upper frame element sections 71",71" are telescopingly received by a corresponding other of the sections to facilitate collapse of the upper frame elements 65" from respective erect configurations to respective collapsed configurations. The telescoping upper frame element sections 71",71" are maintained in their erect configuration with an interference fit or a cooperating detent and recess design, as described above and as would be readily understood by one skilled in the art.

Each of the webs 51, which correspond in number to the lower frame elements 47 and partition walls 33 of the structure 21, is attached to at least one of the central support 29, a corresponding lower frame element and a corresponding upper frame element 65 at attachment points 85 on the web (FIG. 1). As with the central support 29, lower frame elements 47 and upper frame elements 65, the webs 51 are movable from a substantially erect configuration, wherein the webs are oriented substantially vertically to arrest movement of objects, to a substantially collapsed configuration, wherein the webs are substantially adjacent the collapsed central support, lower frame elements and upper frame elements. As shown in FIG. 1, each web 51 is attached to all three structural members 29,47,65. The webs 51 depicted in FIG. 1 are partially removed to show other details of the structure 21. In use, however, such webs 51 would preferably extend over the entire area of each partition wall 33. The webs 51 may attach to the structure 21 by any suitable means. Preferably, each web 51 securely, yet movably, attaches to respective structural members 29,47,65, thereby allowing each web to move slightly along the length of the structural member to ensure that the web can move and collapse with the structural members as they collapse. This movement also allows the webs 51 to move slightly when impacted with a moving object, so that the object is slowed quickly and in a short distance, without undue jarring of the structure 21. It will also be understood that the webs 51 may attach to fewer than all of its adjacent structural members without departing from the scope of the present invention.

Attaching the web 51 to each of the structural members 29,47,65 of the structure 21 further enhances the ability of the structure 21 to shield occupants from moving objects because it minimizes the likelihood that a moving object could pass between a structural member and the web near an edge of the web. Attaching the web 51 to each of the structural members 29,47,65 at the multiple attachment points 85, preferably close to one another, enhances the ability of the structure 21 to shield occupants from moving objects. The web 51 may be attached to the structure 21 by various methods. For example, the web 51 of FIG. 1 includes loops 89 at each attachment point 85 that wrap around an adjacent structural member 29,47,65 for securing the web. Such loops may, for example, be comprised of metal, plastic or fabric, among others, and may be formed in the shape of rings, loops or sleeves, among other configurations. In some configurations, the web 51 is removably attached to the structure 21, such as with hook and loop fasteners for each loop 89, so that different webs can be attached to the structure. The webs 51 can also be continuously attached to the structural members 29,47,65 along their edges, such as by forming sleeves along each web edge through which a corresponding structural member may pass. The webs 51 can be comprised of different materials to provide various physical characteristics. For instance, such material characteristics include rebound, resiliency, wind penetration, light penetration, color and reflectance, among others.

Each web 51 preferably includes openings, such as holes, allowing light and air to pass through the partition walls 33 of the structure 21. Such holes provide simultaneous viewing of each of the compartments 25 to facilitate supervision and viewing of occupants. Moreover, such holes minimize the wind forces on the structure 21 and allow adequate light to fall within each of the compartments 25. Such holes are ideally smaller than the moving objects, so that the web 51 can consistently arrest movement of the moving objects. In the case of baseballs, for example, such holes must be smaller than the size of a baseball. An example of a suitable web material is a mesh, or netting, material.

In addition to the webs 51 associated with each partition wall 33, a gusset 91 of pliable material also extends between the inner portions of each pair of adjacent partition walls (FIGS. 1 and 3). Gussets 91 extend between the inner portions of each pair of adjacent webs 51 to protect the central support 29 of the structure 21 from being struck by a moving object. As depicted in FIGS. 1 and 3, the gussets 91 are rectangular in shape, extending the full height of the central support 29 and attaching to the adjacent webs 51 along lateral edges 93 of the gusset. Although shown partially in FIG. 1 and with respect to only two compartments 25 in FIG. 3, such gussets 91 are arranged in each compartment and extend the full vertical length of the partition walls 33. The lateral edges 93 of each gusset 91 attach to the inner portions of the webs 51 at attachment points 94, so that moving objects hitting the gussets will be restrained from hitting the central support 29 of the structure 21. By configuring the width of each gusset 91 and the location of the attachment points 94 of each gusset, each gusset is configured so that any movement of the gusset toward the central support 29 due to an impact of a moving object will be less than the distance to the central support. By controlling the width and attachment points 94 of each gusset 91, moving objects may be stopped before striking the central support 29 of the structure 21. Gussets 91 are formed from pliable materials, similar to those of the web. Gussets 91 may also be formed from different shapes without departing from the scope of the present invention. For example, gussets 91 may be wider than those depicted in the figures, thereby requiring attachment points 94 more radially outward from the central support 29 to provide protection for the central support.

Similarly, the structure 21 further comprises cushioning members 95 surrounding each of the structural members 29,47,65 to help protect such members from damage caused by fast-moving objects (FIG. 1). Such cushioning members 95 may also help protect occupants from injury when playing in or around the structure 21, which may result in an occupant falling or colliding with the structure. Such cushioning members 95 may be formed from any cushioning material, but are preferably formed from foam rubber. FIG. 1 depicts cushioning members 95 surrounding only portions of the structural members 29,47,65 of one partition wall 33. One skilled in the art would readily appreciate that such cushioning members 95 may surround each of the structural members 29,47,65.

The structure 21 further comprises stakes 99 for anchoring the lower frame elements 47 to the ground. Stakes 99 are preferably received in holes formed in end plates 101 of the lower frame elements 47 (FIG. 1). Stakes 99 may also be arranged along the length of the lower frame elements 47 to secure the lower frame elements adjacent the ground. In addition, the base 41 of the central support 29 includes additional holes 107 sized and shaped for receiving stakes 99. The structure 21 may also include other attachment devices for attaching the structure to the ground or other surfaces, such as pavement, asphalt, tile flooring or wood flooring, among others. Such attachment devices might include screws, bolts, adhesives, hook and loop fasteners, suctions cups and the like. It should also be understood that the structure 21 may be used without anchoring of any kind.

Figure 7A:
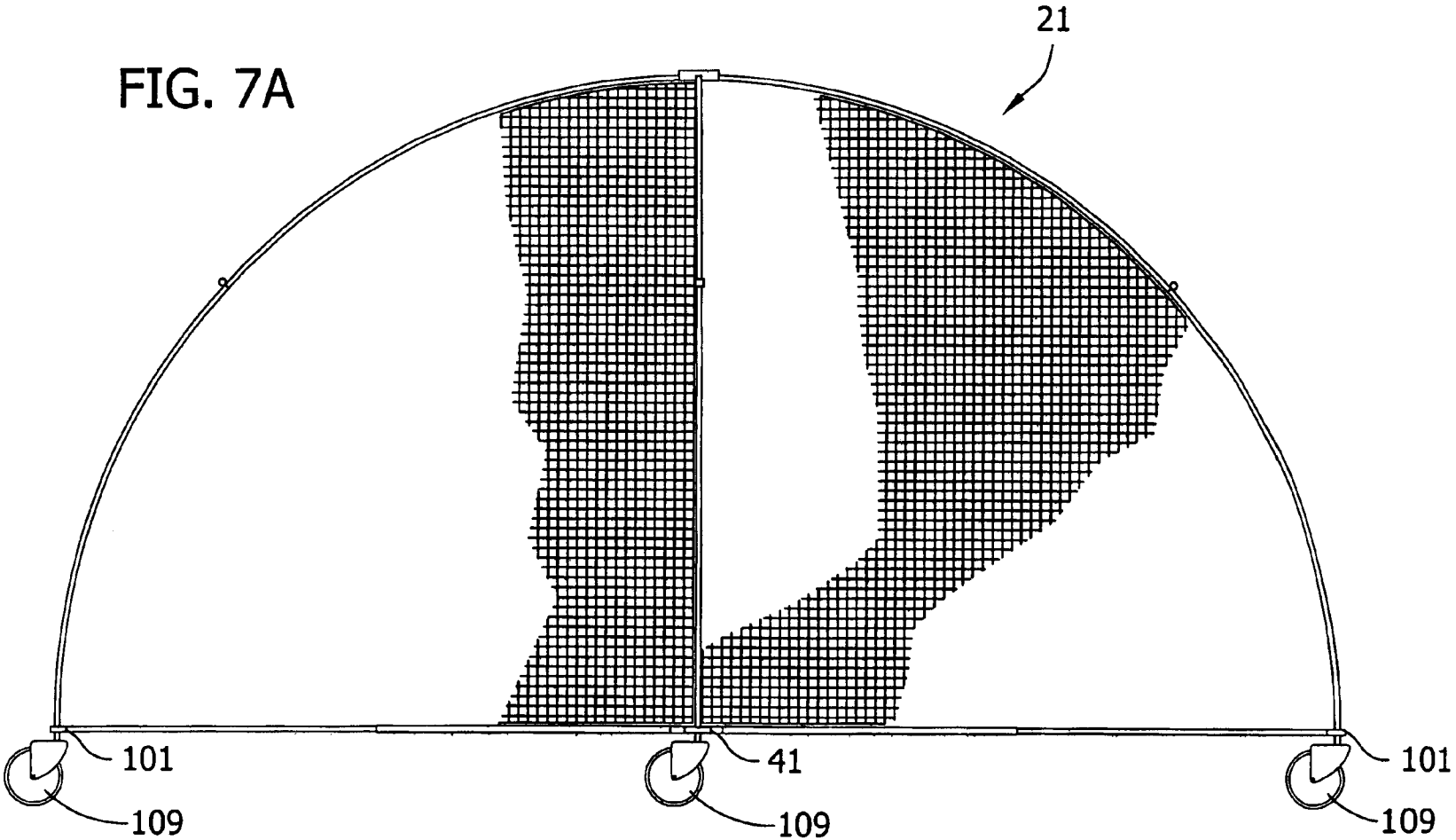
FIG. 7A is an elevation of yet another collapsible partition structure including wheels allowing movement of the structure by rolling.

In another embodiment of the structure 21 of the present invention, the invention further comprises wheels 109 mounted on the underside of the structure to support the structure and allow for its movement in its erect configuration by rolling (FIG. 7A). Such wheels 109 preferably attach to the base 41 and each of the end plates 101 so the structure 21 is fully supported for ease in rolling. The wheels 109 detach from the structure 21 so that it may be erected with or without such wheels. The wheels 109 preferably pivot about a vertical axis so that the structure may be moved in any direction with the wheels self-correcting their orientation. Such wheels 109 include casters, among others, as would be understood by one skilled in the art. Although wheels 109 are only depicted with the structure 21 of FIG. 7A, it should be understood by those skilled in the art that wheels may be mounted on any of the disclosed structures. In addition, the wheels 109 may be mounted on the structure 21 to retract upward, so that the structure may be rolled to a desired location and then lowered to sit flush with the ground by retracting the wheels upward. Such retractable wheels are well known to those skilled in the art. Thus, their construction will not be recited in detail here. Instead of retractable wheels, it is also contemplated that the webs 51 may extend down below the lower frame elements 47 to touch the ground, thereby inhibiting moving objects from passing beneath the lower frame elements (not shown).

Figure 8:
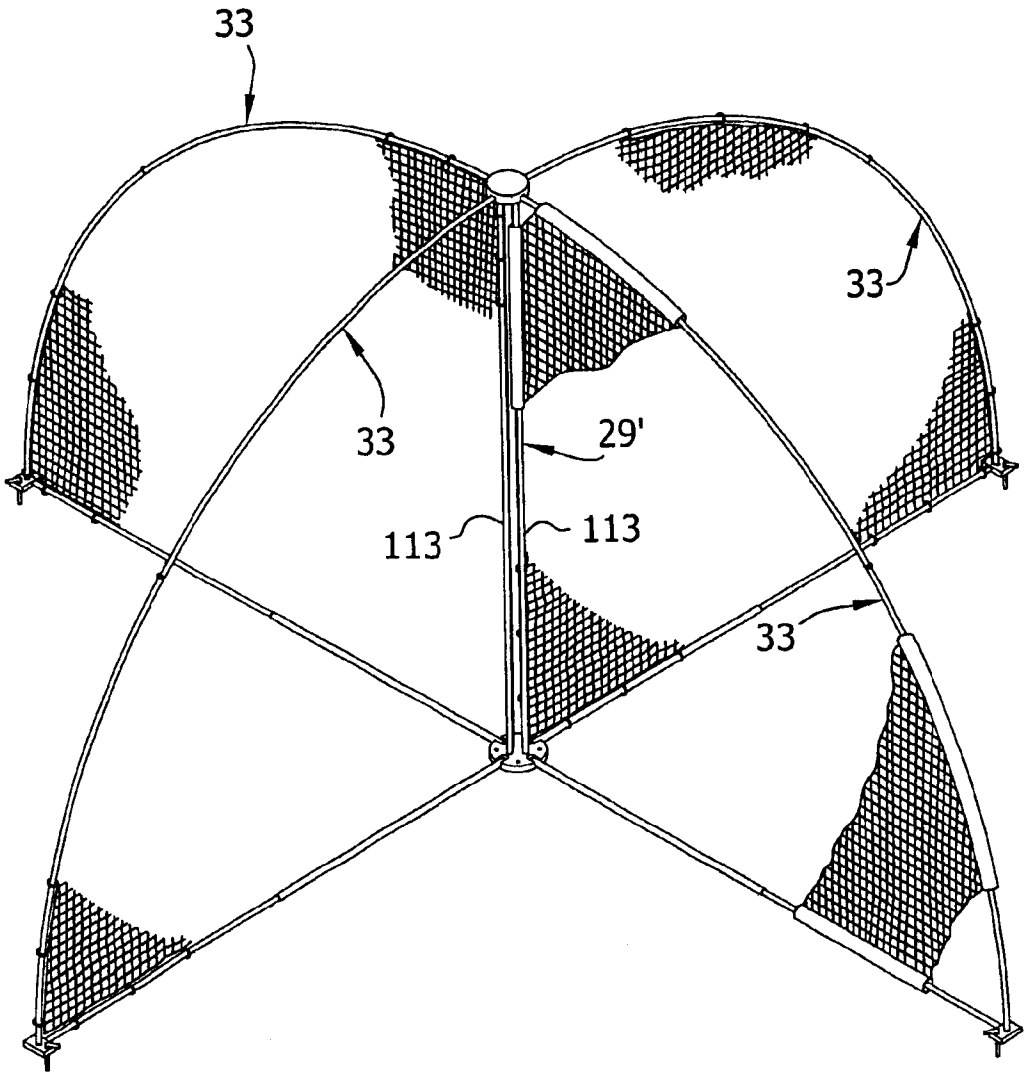
FIG. 8 is a perspective view of still another partition structure comprising multiple vertical supports.

In yet another embodiment of the structure 21 of the present invention, the central support, generally indicated 29', comprises a vertical support 113 corresponding to each of the partition walls 33 (FIG. 8). Each of the vertical supports 113 provides the structural support for a particular partition wall 33. The vertical supports 113 may include sections (not shown) similar to the central support sections 55 depicted in FIG. 1. Such sections are movable with respect to one another to facilitate collapse of the vertical supports 113 from respective erect configurations to respective collapsed configurations. Such sections are collapsible in a variety of ways as described above.

Figure 9:
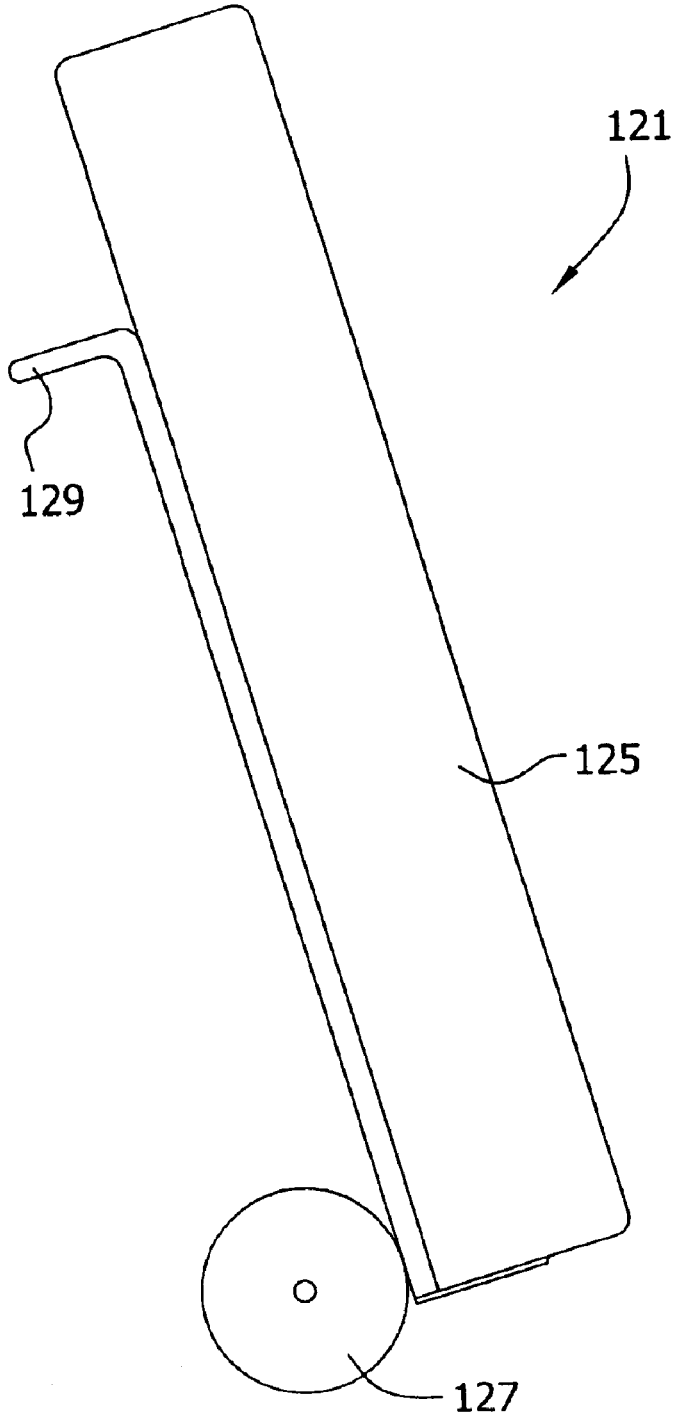
FIGS. 9 and 10 are elevations of collapsible backstop systems of the present invention.
Figure 10:
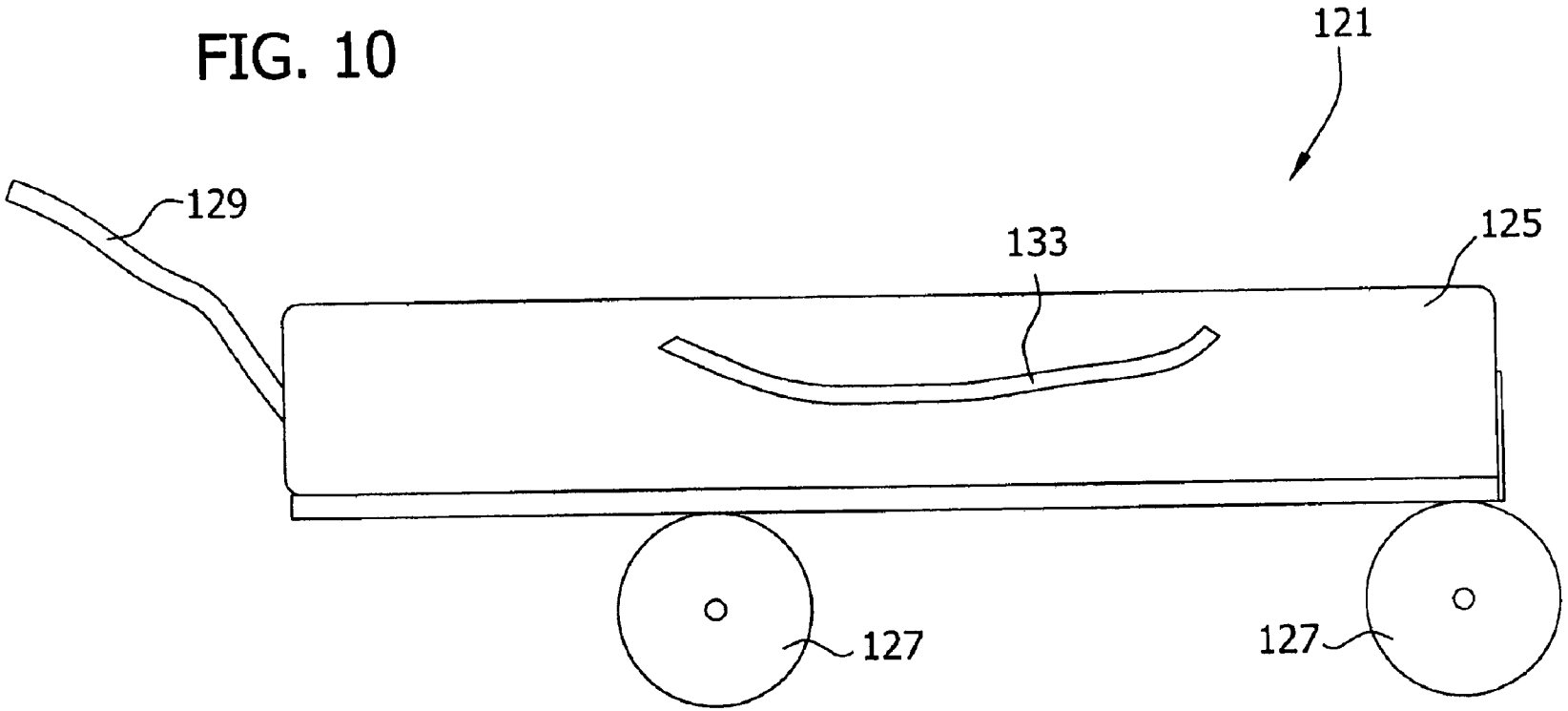

In yet another embodiment of the present invention, a collapsible backstop system, generally indicated 121, is disclosed (FIGS. 9 and 10). The collapsible backstop system includes a structure, herein a backstop, as described above adapted to arrest movement of objects. The backstop is also capable of alternating between an erect configuration for arresting such movement, and a collapsed configuration for transport or storage. A volume defined by the backstop is divided into compartments, generally as set forth above. The backstop is similar to the structure 21 described above, except that the system 121 additionally includes a container 125 shaped and sized for receiving the backstop in its collapsed configuration for storing or transporting the backstop. The container 125 may be of any suitable type, including a bag, case or box. The container 125 may be formed with or without wheels 127 for rolling the container. Moreover, the system 121 preferably comprises pull handles 129 or straps 133 for carrying or pulling the container 125.

Figure 11:
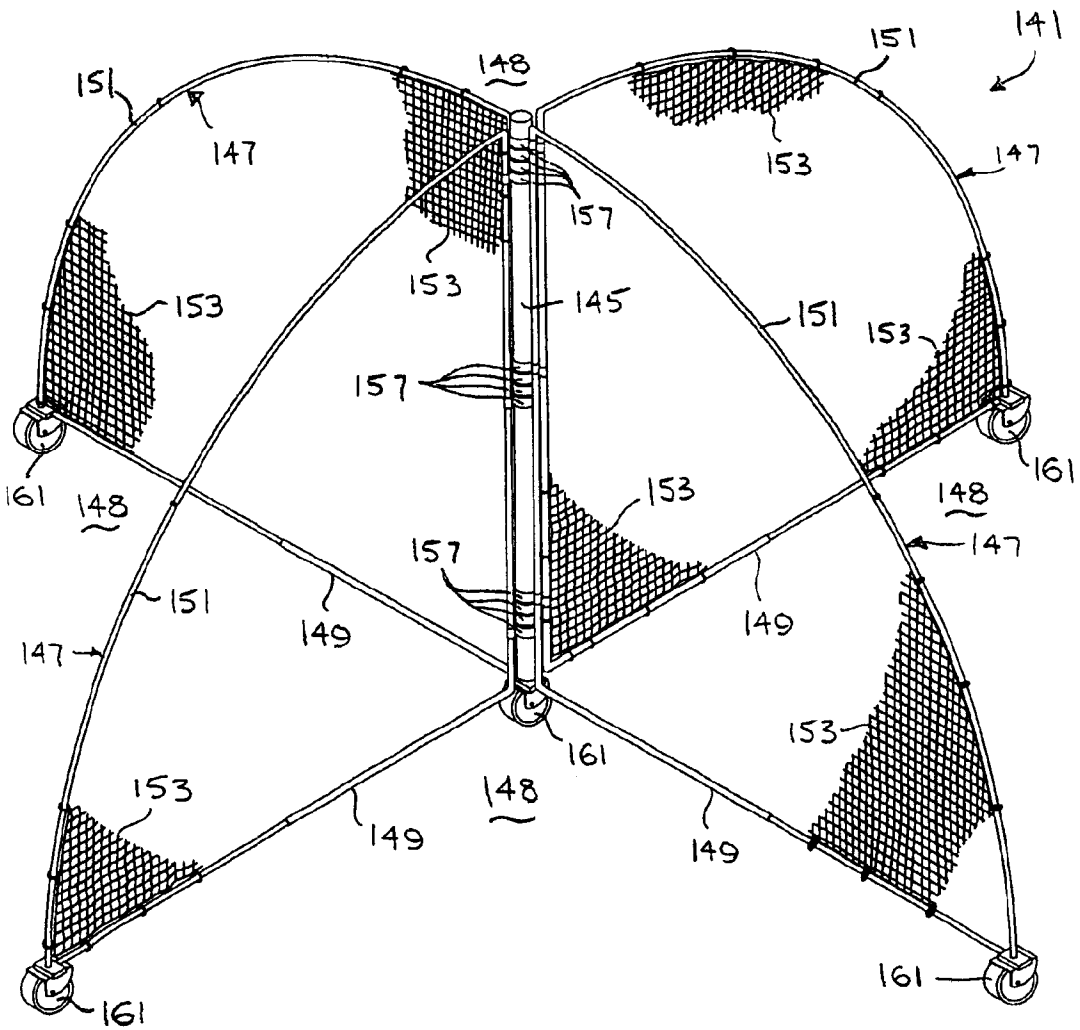
FIG. 11 is a perspective view of yet another partition structure comprising pivotable partition walls.
Figure 12:
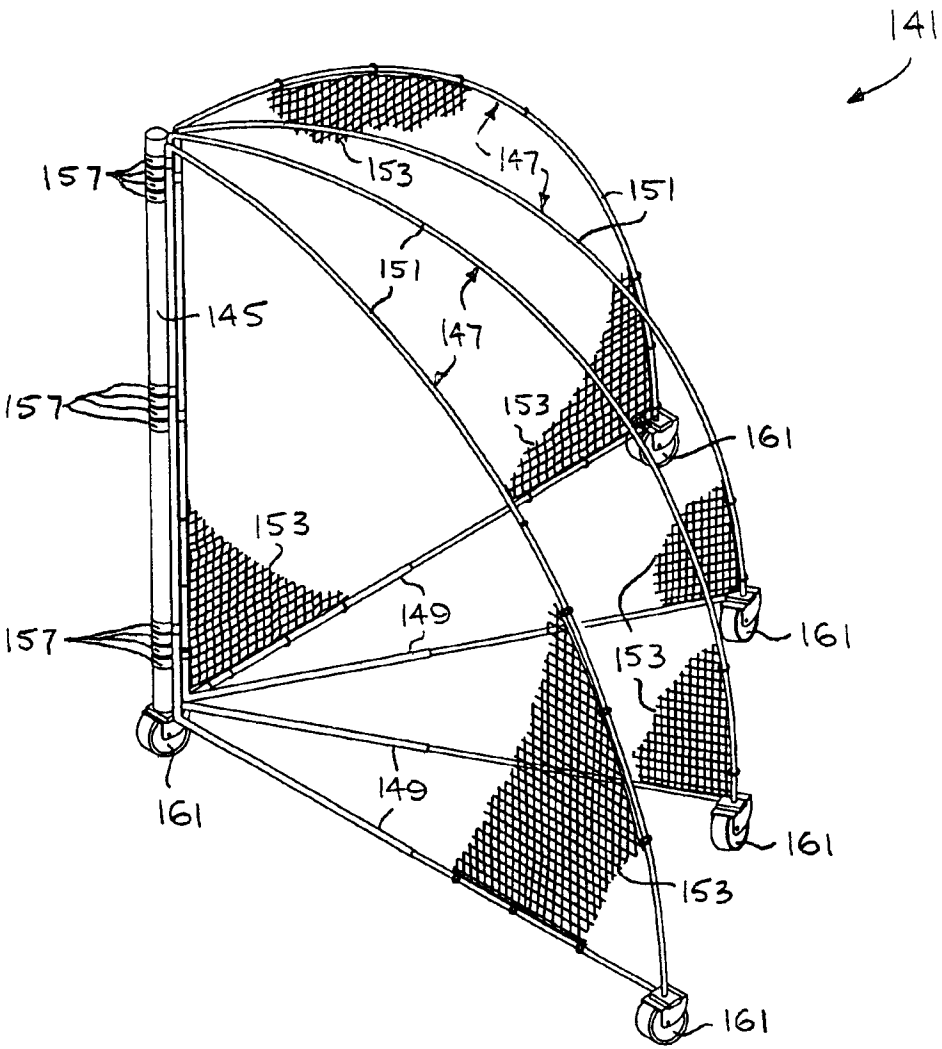
FIG. 12 is a perspective view of the partition structure shown in a partially collapsed configuration.
Figure 13:
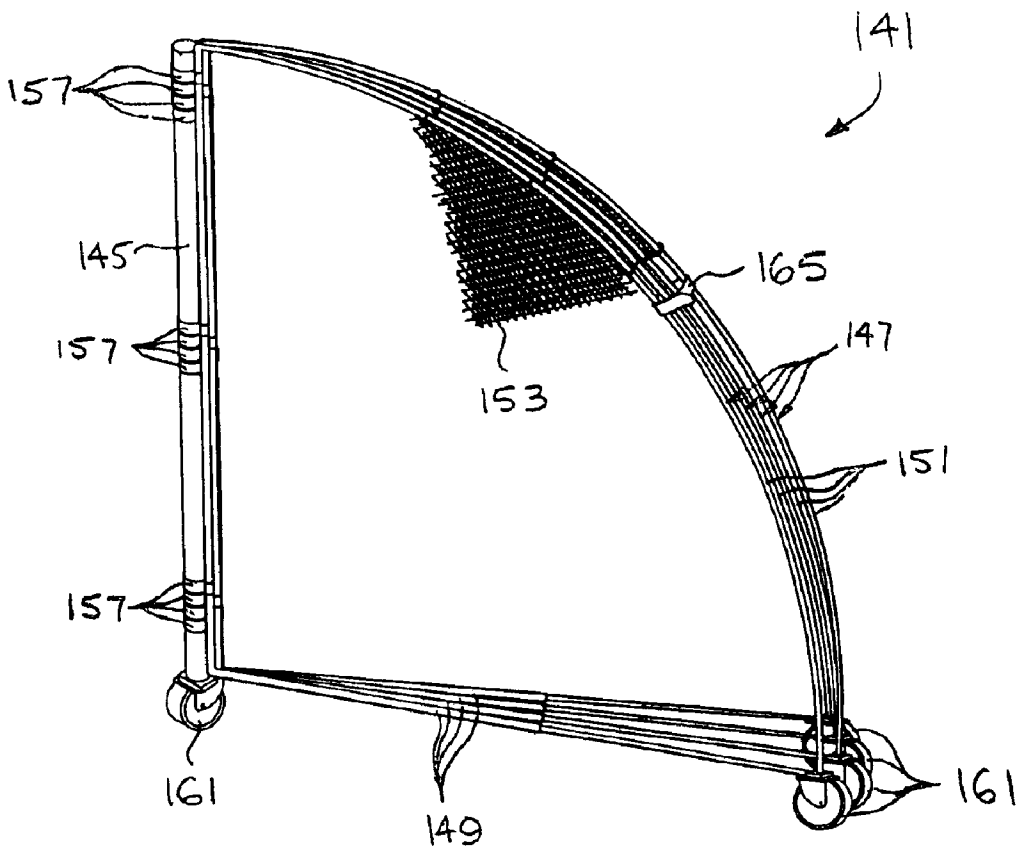
FIG. 13 is a perspective view of the partition structure shown in a fully collapsed configuration.

Referring now to FIGS. 11–13, a further partition structure is generally indicated 141. FIG. 11 depicts the partition structure 141 in an erect configuration, FIG. 12 depicts the partition structure in a partially collapsed configuration, and FIG. 13 depicts the partition structure in a collapsed configuration. The structure generally comprises a central support 145 and partition walls, generally indicated 147, extending from the central support to form compartments 148. Each of the partition walls 147 comprises a lower frame element 149, an upper frame element 151 and a pliable web 153 of material extending between the central support 145 and the lower and upper frame elements for shielding each of the compartments 148 from the others. Each of the partition walls 147 is hinged about the central support 145 by hinges 157 for pivoting movement of each partition wall about a substantially vertical axis adjacent the central support. Thus, in addition to collapsing individual structural members, as disclosed above, the structure 141 may alternately collapse by pivoting the partition walls 147 about the central support 145 to position the walls substantially adjacent one another. In this collapsed configuration, shown in FIG. 13, the partition walls 147 are positioned substantially parallel to one another. This collapsed configuration allows the structure 141 to be more easily moved from one location to another. In addition, the collapsed structure 141 may be stored more compactly. Finally, because none of the structural members are individually collapsed, altering the structure 141 from the collapsed configuration (FIG. 13) to the erect configuration (FIG. 11) may be achieved relatively quickly and with little effort, by simply pivoting the partition walls 147 about the central support 145. The structure 141 additionally includes wheels 161, facilitating movement of the device, generally as set forth above. In the collapsed configuration, a strap 165 wraps about the upper frame elements 151 to hold the partition walls 147 of the structure 141 in place (FIG. 13). The structure 141 may additionally include braces or supports (not shown) between adjacent partition walls 147 to facilitate locating and maintaining the partition walls in appropriate angular positions, when in the erect configurations.

In view of the above, it will be seen that the several objects of the invention are achieved and other advantageous results attained.

When introducing elements of the present invention or the preferred embodiment thereof, the articles "a," "an," "the," and "said" are intended to mean that there are one or more of the elements. The terms "comprising," "including," and "having" are intended to be inclusive and mean that there may be additional elements other than the listed elements.

As various changes could be made in the above construction and method without departing from the scope of the invention, it is intended that all matter contained in the above description and shown in the accompanying drawings shall be interpreted as illustrative and not in a limited sense.

What is claimed is:

1. A partition structure for defining compartments shielded from moving objects, such as baseballs, from other compartments, the structure comprising a central support, at least three partition walls shaped and sized to extend substantially radially outwardly from the central support, the partition walls being constructed to define at least three of said compartments, each partition wall includes a lower frame element and a pliable web of material extending therefrom for shielding one of said compartments from the others, the web extending from the central support to a radially outer end of the partition wall.

2. A partition structure as set forth in claim 1 wherein there are four partition walls and four compartments.

3. A partition structure as set forth in claim 1 wherein the central support comprises a vertical support corresponding to each of said partition walls.

4. A partition structure as set forth in claim 1 wherein the partition structure is collapsible.

5. A partition structure as set forth in claim 4 wherein said central support and said lower frame elements are each collapsible to a length less than their respective original lengths.

6. A partition structure as set forth in claim 5 wherein said central support and said lower frame elements each comprise at least two sections, central support sections and lower frame element sections, respectively, movable with respect to one another to respective collapsed configurations.

7. A partition structure as set forth in claim 6 wherein said central support comprises a base at its lower end and an upper joint at its upper end.

8. A partition structure as set forth in claim 7 wherein said lower frame elements are hinged for pivoting about said base from a substantially horizontal orientation to a substantially vertical orientation adjacent said central support.

9. A partition structure as set forth in claim 8 wherein at least one of said at least two central support sections and at least one of said at least two sections of each of said lower frame element sections are telescopingly received by a corresponding other of said sections to facilitate collapse of said central support and collapse of said lower frame elements to respective collapsed configurations.

10. A partition structure as set forth in claim 8 wherein each of said at least two central support sections and each of said at least two lower frame element sections are hingedly connectable to one another, so that said sections may be pivoted with respect to one another from an erect configuration, wherein corresponding sections are arranged end-to-end, to a collapsed configuration, wherein said sections are substantially parallel and substantially adjacent one another.

11. A partition structure as set forth in claim 7 further comprising at least three upper frame elements, each of said upper frame elements corresponds to one of said at least three partition walls and extends from said upper joint to a remote end of a corresponding lower frame element.

12. A partition structure as set forth in claim 11 wherein each of said webs is attachable to at least one of the central support, a corresponding lower frame element and a corresponding upper frame element at locations on said web.

13. A partition structure as set forth in claim 11 wherein each of said upper frame elements comprises at least two upper frame element sections movable with respect to one another for collapsing to a collapsed configuration adjacent said central support.

14. A partition structure as set forth in claim 13 wherein at least one of said upper frame elements is arcuate.

15. A partition structure as set forth in claim 13 wherein said at least one of said upper frame elements includes a bend.

16. A partition structure as set forth in claim 13 wherein at least one of said upper frame elements includes at least one hinge, thereby allowing said at least two upper frame element sections to pivot with respect to one another.

17. A partition structure as set forth in claim 4 wherein each of said partition walls is pivotable about a substantially vertical axis for pivoting movement of each of said partition walls to a position substantially parallel with at least one adjacent wall.

18. A partition structure as set forth in claim 17 wherein said partition walls are pivotable to positions substantially adjacent one another.

19. A partition structure as set forth in claim 1 wherein said web includes holes smaller than said moving objects.

20. A partition structure as set forth in claim 19 wherein said web comprises a mesh material.

21. A partition structure as set forth in claim 1 further comprising gussets extending between inner portions of each pair of adjacent partition walls to protect the central support of the structure from being struck by said moving objects.

22. A partition structure as set forth in claim 1 further comprising stakes for anchoring said lower frame elements to the ground.

23. A partition structure as set forth in claim 1 further comprising wheels mounted to support the structure and allow for its movement by rolling.

24. A collapsible structure for arresting the movement of moving objects, said structure comprising:

a central support oriented substantially vertically, said central support being movable between an erect configuration and a collapsed configuration, wherein said central support is longer in the erect configuration than in the collapsed configuration;

at least three lower frame elements pivotably attachable to a lower end of said central support, said lower frame elements being movable from an erect configuration to a collapsed configuration, wherein each of said lower frame elements is longer in an erect configuration than in a collapsed configuration, wherein said lower frame elements are substantially perpendicular to said central support and extend laterally outwardly when in said erect configuration and are substantially parallel and substantially adjacent said central support when in said collapsed configuration;

upper frame elements corresponding in number to said at least three lower frame elements, wherein each of said upper frame elements extends from said central support to a remote end of a corresponding lower frame element; and webs corresponding in number to said at least three lower frame elements, wherein each of said webs extends between said central support and a corresponding lower frame element and is movable from a substantially erect configuration, wherein each web is oriented substantially vertically to arrest movement of said moving objects, to a substantially collapsed configuration, wherein each web is substantially adjacent a corresponding lower frame element and said central support.

25. A collapsible backstop system, said system comprising:

a collapsible backstop shaped and sized to arrest movement of objects, said collapsible backstop capable of alternating between an erect configuration for arresting said movement, and a collapsed configuration shaped and sized for transport or storage of said backstop, said backstop comprising at least three collapsible partition walls, and a central support for mounting each of said partition walls in a substantially vertical orientation to divide a volume defined by said backstop into compartments, said partition walls being shaped and sized to shield said compartments from moving objects from other compartments; and a container shaped and sized for receiving said collapsible backstop in its collapsed configuration for storing or transporting said backstop.

26. A system as set forth in claim 25 wherein said container is a bag.

27. A system as set forth in claim 25 wherein said container further comprises wheels.

28. A collapsible partition structure for defining compartments shielded from moving objects, such as baseballs, from other compartments, the structure comprising at least three partition walls oriented substantially vertically, each of said partition walls having a substantially vertical inner end and an outer end opposite said inner end, said inner ends of said partition walls being positioned substantially adjacent one another such that said partition walls extend substantially radially outwardly from the center of the structure, the partition walls being constructed to define at least three of said compartments, each partition wall including a pliable web of material extending therefrom for shielding one of said compartments from the others, each web extending from said inner end of a corresponding partition wall to a radially outer end of the partition wall.

* * * * *